US010125000B2

(12) United States Patent
Kent

(10) Patent No.: US 10,125,000 B2
(45) Date of Patent: Nov. 13, 2018

(54) CAN OPENER

(71) Applicant: Progressive International Corporation, Kent, WA (US)

(72) Inventor: Joseph Kent, Seattle, WA (US)

(73) Assignee: PROGRESSIVE INTERNATIONAL CORPORATION, Kent, WA (US)

( * ) Notice: Subject to any disclaimer, the term of this patent is extended or adjusted under 35 U.S.C. 154(b) by 171 days.

(21) Appl. No.: 15/013,761

(22) Filed: Feb. 2, 2016

(65) Prior Publication Data

US 2016/0221814 A1 Aug. 4, 2016

Related U.S. Application Data

(60) Provisional application No. 62/112,050, filed on Feb. 4, 2015.

(51) Int. Cl.

| | |
|---|---|
| ***B67B 7/00*** | (2006.01) |
| ***B67B 7/70*** | (2006.01) |
| ***B67B 7/46*** | (2006.01) |

(52) U.S. Cl.
CPC . *B67B 7/32* (2013.01); *B67B 7/34* (2013.01)

(58) Field of Classification Search
CPC .... B67B 7/30; B67B 7/32; B67B 7/34; B67B 7/36; B67B 2007/303; B67B 2007/306
USPC ..... 30/416–427, 433, 434
See application file for complete search history.

(56) References Cited

U.S. PATENT DOCUMENTS

| | | | | | |
|---|---|---|---|---|---|
| 5,205,195 | A * | 4/1993 | Crosslen | B09B 3/0058 | 30/418 |
| 5,291,658 | A * | 3/1994 | Wilson | B67B 7/34 | 30/418 |
| 5,802,725 | A * | 9/1998 | Drifka | B67B 7/34 | 30/416 |
| 5,946,811 | A * | 9/1999 | Chang | B67B 7/34 | 30/417 |
| 5,970,618 | A * | 10/1999 | Kuo | B67B 7/34 | 30/416 |
| 6,101,727 | A * | 8/2000 | Chong | B67B 7/34 | 30/417 |
| 6,789,325 | B2 * | 9/2004 | Wilson | B67B 7/34 | 30/416 |
| 7,168,170 | B1 * | 1/2007 | So | B67B 7/32 | 30/416 |
| D562,658 | S * | 2/2008 | So | D8/41 | |
| 7,353,607 | B2 * | 4/2008 | So | B67B 7/32 | 30/416 |

(Continued)

FOREIGN PATENT DOCUMENTS

| | | | | |
|---|---|---|---|---|
| CA | 2491065 | A1 * | 3/2006 | B67B 7/32 |
| CA | 2553538 | A1 * | 2/2007 | B67B 7/32 |

(Continued)

*Primary Examiner* — Jason Daniel Prone
(74) *Attorney, Agent, or Firm* — Lowe Graham Jones PLLC

(57) ABSTRACT

A can opener includes a pair of handles attached for pivotal movement between an open position to receive a rim of a can and a closed position to trap the rim between a cutting blade and a traction wheel. A crank having a handle is positioned on one side of the pair of handles and includes a cavity formed in the crank for housing a ratchet assembly configured to drive a traction wheel located on the opposite side of the pair of pivoting handles.

20 Claims, 9 Drawing Sheets

(56) References Cited

U.S. PATENT DOCUMENTS

| | | | | |
|---|---|---|---|---|
| 7,574,808 | B2 * | 8/2009 | Mah | B67B 7/32 30/422 |
| 7,587,831 | B2 * | 9/2009 | So | B67B 7/32 30/416 |
| 7,596,874 | B2 * | 10/2009 | Mah | B67B 7/34 30/422 |
| 2005/0198838 | A1 * | 9/2005 | Brucart Bonich | B67B 7/32 30/416 |
| 2016/0368750 | A1 * | 12/2016 | Kalogroulis | B67B 7/32 30/418 |
| 2018/0118546 | A1 * | 5/2018 | Chang | B67B 7/34 |

FOREIGN PATENT DOCUMENTS

| | | | | |
|---|---|---|---|---|
| EP | 1454874 | A1 * | 9/2004 | B67B 7/32 |
| EP | 1642860 | A1 * | 4/2006 | B67B 7/32 |
| EP | 1752412 | A1 * | 2/2007 | B67B 7/32 |
| GB | 2161449 | A * | 1/1986 | B67B 7/34 |
| GB | 2352435 | A * | 1/2001 | B67B 7/44 |
| GB | 2418657 | A * | 4/2006 | B67B 7/32 |
| JP | 2006103800 | A * | 4/2006 | B67B 7/32 |
| WO | WO 03043929 | A1 * | 5/2003 | B67B 7/32 |
| WO | WO 2014191881 | A2 * | 12/2014 | B67B 7/34 |

* cited by examiner

CAN OPENER

PRIORITY CLAIM

This application claims priority to U.S. Provisional Application No. 62/112,050, filed Feb. 4, 2015, the contents of which are incorporated by reference.

FIELD OF THE INVENTION

This invention relates generally to hand-operated can openers.

BACKGROUND OF THE INVENTION

A variety of can openers are currently available for removing an upper lid from a can by cutting around the interior edge of the lid, including can openers operable by a ratchet handle. One such example is described in U.S. Pat. No. 7,353,607. The '607 patent illustrates a can opener having a pair of pivoting handles and a cutter blade movable by the respective handles for cutting open a can. A pivotable lever drives a ratchet assembly through the use of a spring-loaded pawl, which turns a traction wheel. The ratchet assembly is located within a casing mounted in a chamber formed in a front portion of one of the two handle members. This configuration is useful for opening a can, but requires a bulbous and complex front casing and chamber configuration.

SUMMARY OF THE INVENTION

A preferred version of a can opener includes a pair of handles attached for pivotal movement between an open position to receive a rim of a can and a closed position to trap the rim between a cutting blade and a traction wheel. A crank having a handle is positioned on one side of the pair of handles and includes a cavity formed in the crank for housing a ratchet assembly configured to drive a traction wheel located on the opposite side of the pair of pivoting handles.

In some versions of the invention, the crank handle is attached to a crank case, the crank case being attached to the first handle and having interior sidewalls forming cylindrical interior cavity and terminating in a rim, the sidewalls having at least one rib positioned on the sidewalls and extending axially along the sidewall.

In some versions, a ratchet assembly is carried within the crank case for operation by the crank handle and crank case. The ratchet assembly may include a first gear having at least one slot configured to receive the at least one rib wherein the first gear is axially movable within the crank case cavity along the rib, the first gear having a first set of ratchet teeth.

In some versions, the ratchet assembly also includes a second gear having a second set of ratchet teeth configured to engage the first set of ratchet teeth when the first gear is rotated in a first direction and to slide over the first set of ratchet teeth when the first gear is rotated in a second direction.

The invention preferably further comprises a drive gear coupled to the second gear for rotation together with rotation of the second gear, a traction wheel coupled to the second gear for rotation together with rotation of the second gear, a driven gear attached to the second handle and positioned to be driven by the drive gear when the first handle and the second handle are pivoted toward one another in a closed position, and a blade attached to the second handle adjacent the driven gear.

In some examples, the crank case cavity further includes an interior end wall, and the ratchet assembly comprises a first spring trapped between the interior end wall and the first gear, whereby the first spring urges the first set of ratchet teeth lightly into engagement with the second set of ratchet teeth.

In some examples, an axle extends axially through the first gear, the second gear, and the first spring, and a screw secures the axle to the crank case.

In a preferred example, an end cap is attached to the second gear for rotational movement together with the second gear, the end cap having a circular central portion sized to be received within and enclose the rim of the crank case cavity.

In some versions, a center pin has a first end carried on the end cap and a second end attached to the drive gear and the traction wheel, the second end of the center pin being configured to retain the drive gear and the traction wheel on the first handle.

In preferred versions of the can opener, the drive gear and traction wheel are mounted to the center pin for rotational movement together with the center pin.

In some examples, a second spring is trapped between the end cap and the first handle.

In some versions, the proximal end of the first handle further comprises a collar defining an opening for receiving a portion of the end cap and the center pin. A sleeve may be integrally formed with a plate, the sleeve being received within the collar formed on a first side of the first handle and the mounting plate being positioned on an opposing second side of the first handle.

In some versions, the second gear further comprises a plurality of legs terminating in radially extending feet, and the end cap further comprises a plurality of peripheral slots, a separate one of the legs being received within and retained by a separate one of the plurality of peripheral slots.

In preferred versions, the crank handle is integrally formed with the crank case, and the crank case terminates in a rim that abuts the second handle.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
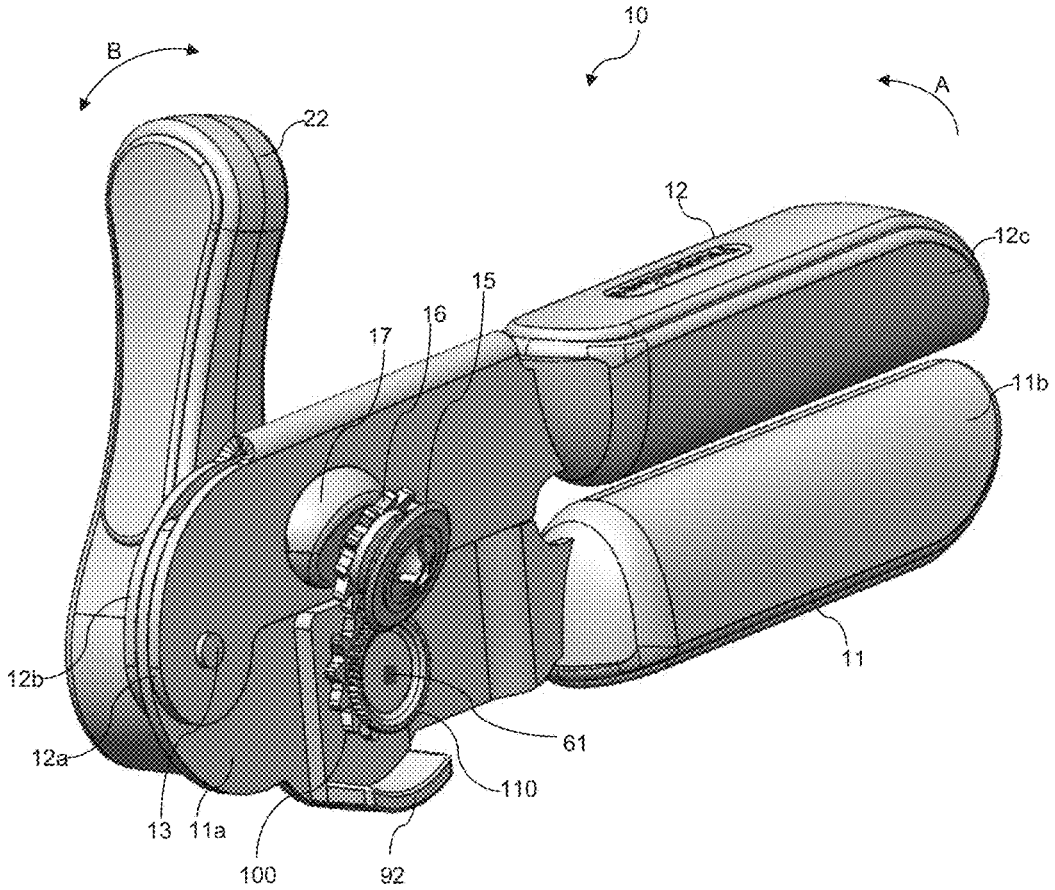
FIG. 1 is a front perspective view of a preferred can opener.
Figure 2:
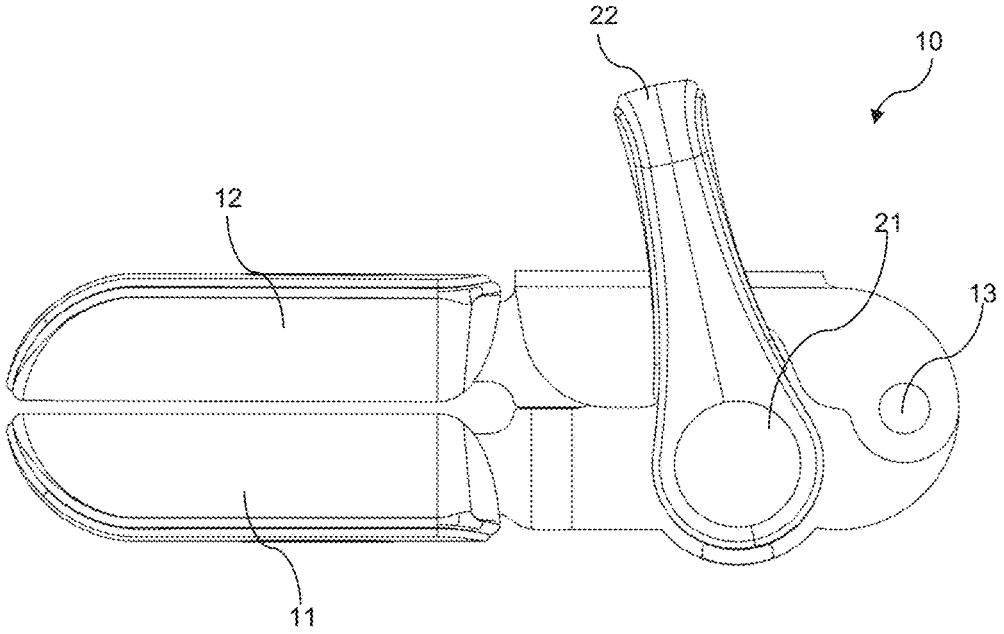
FIG. 2 is a back plan view of a preferred can opener.
Figure 3:
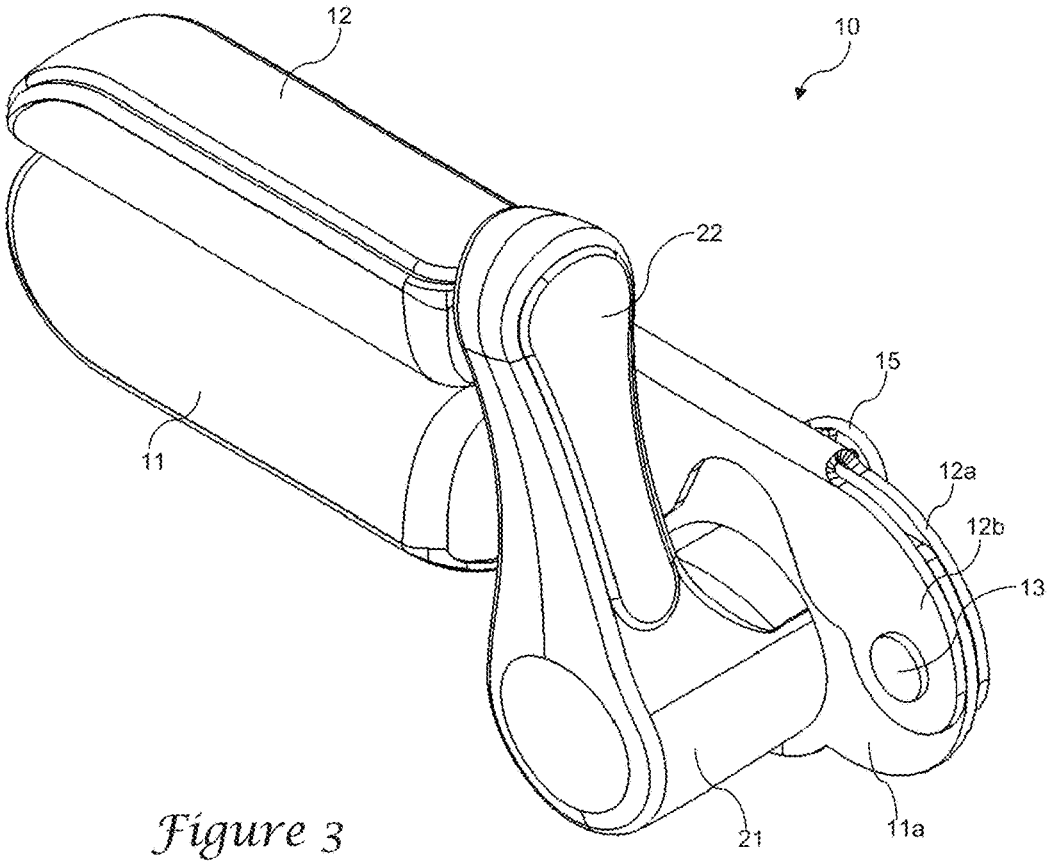
FIG. 3 is a back perspective view of a preferred can opener.
Figure 4:
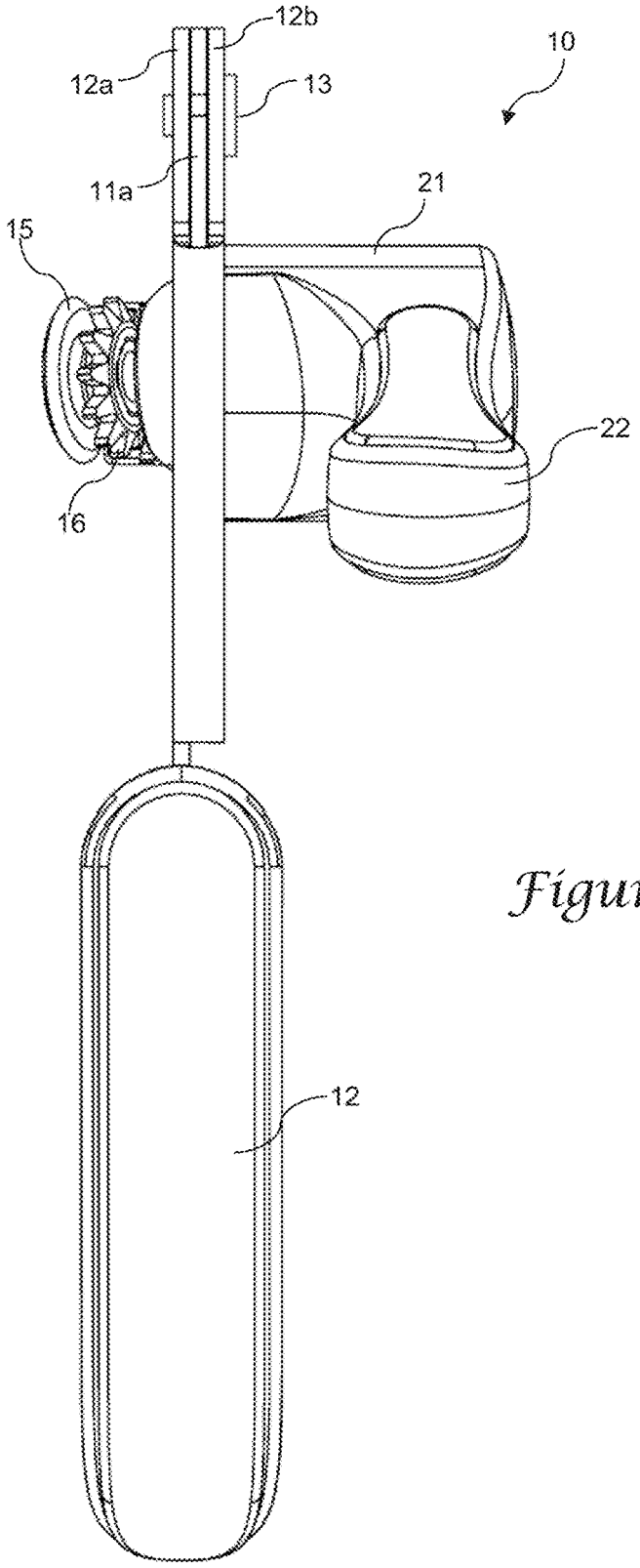
FIG. 4 is a top plan view of a preferred can opener.
Figure 5:
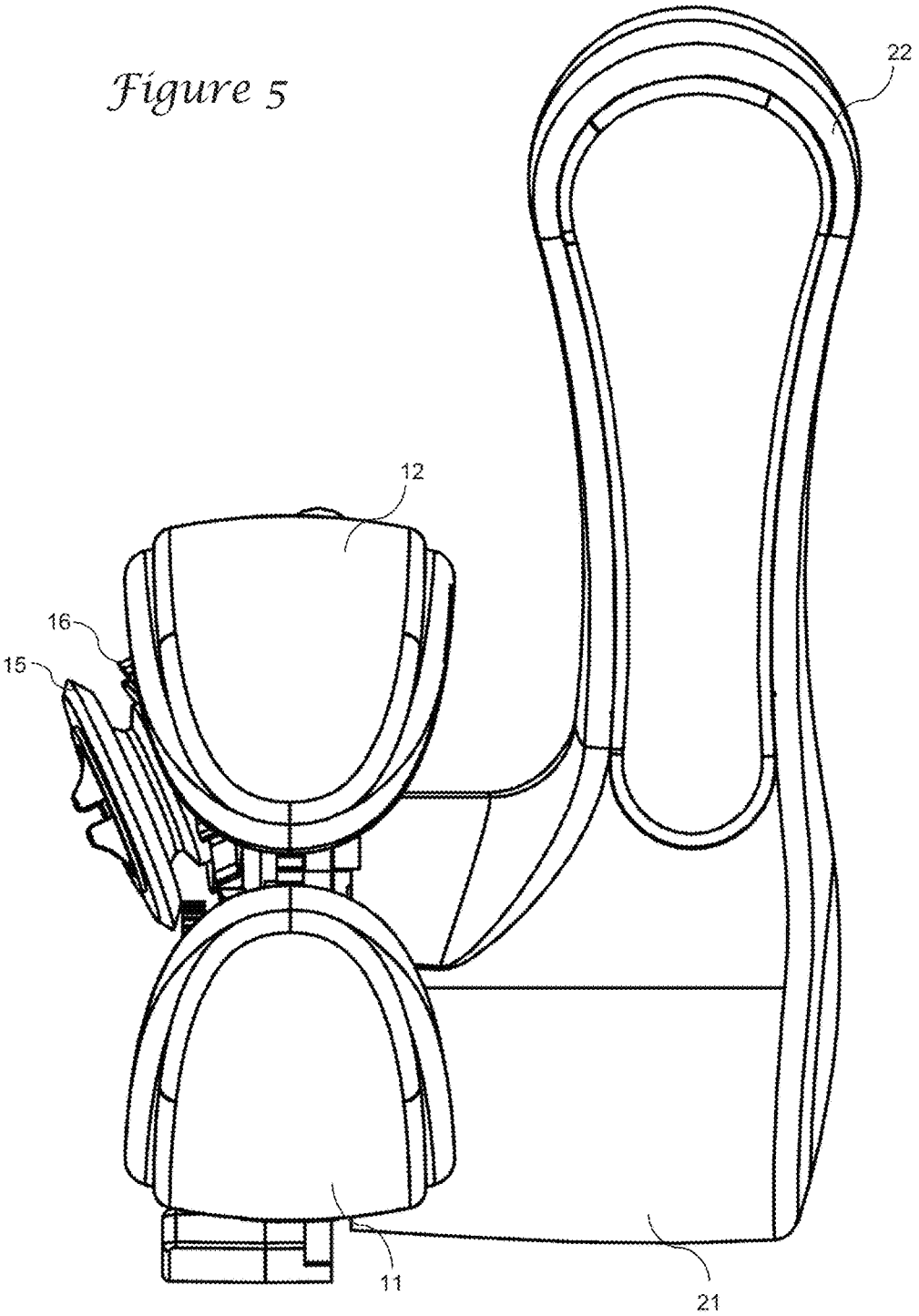
FIG. 5 is a right side view of a preferred can opener.

A preferred can opener 10 is illustrated in various assembled views in FIGS. 1-5. The can opener includes a first handle 11 and a second handle 12, each of the first and second handles being pivotally attached to one another at a pivot point 13 located at a proximal end 11*a*, 12*a*, 12*b* of each of the handles. The handles 11, 12 are illustrated as being in a closed position in FIG. 1, with the distal ends 12*c*, 11*b* adjacent one another, and are further configured to move apart from one another to an open position, such that the distal end 12*c* of the second handle 12 moves apart from the distal end 11*b* of the first handle in the direction of arrow A in FIG. 1.

A crank forming a crank case 21 and having a crank handle 22 is attached to one of the first or second handles, which in the illustrated version is the lower handle or first handle 11. In the illustrated version, the proximal end 11*a* of the first handle 11 is received within a forked proximal end of the second handle 12, forming a pair of opposing plates 12*a*, 12*b* defining a slot to receive the proximal end of the first handle. The handles are then joined to one another at the pivot point 13, which may fasten them together via a rivet, bolt, or other fastener.

Figure 8:
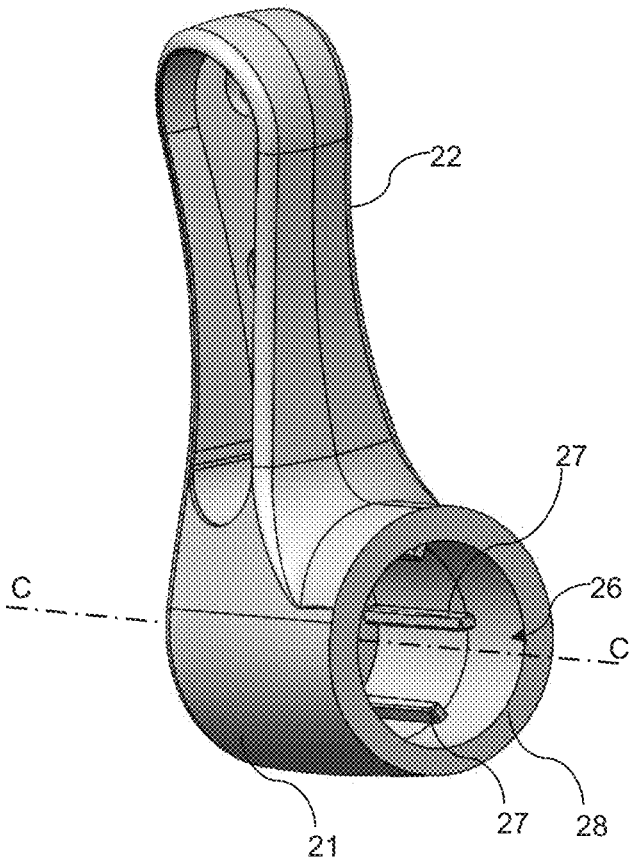
FIG. 8 is a perspective view of a preferred crank handle for a can opener.

As best seen in FIG. 8, the crank case 21 includes an interior cavity 26 configured to receive a ratchet assembly used to drive a blade, as described below. In the preferred example, the ratchet assembly is housed within the cavity 26 formed within the crank case 21, thereby positioning the entire ratchet assembly on one side of the handle to which the crank is attached. The crank case 21 terminates in a rim 28 that abuts the first handle 11 when it is attached to the first handle 11.

Figure 6:
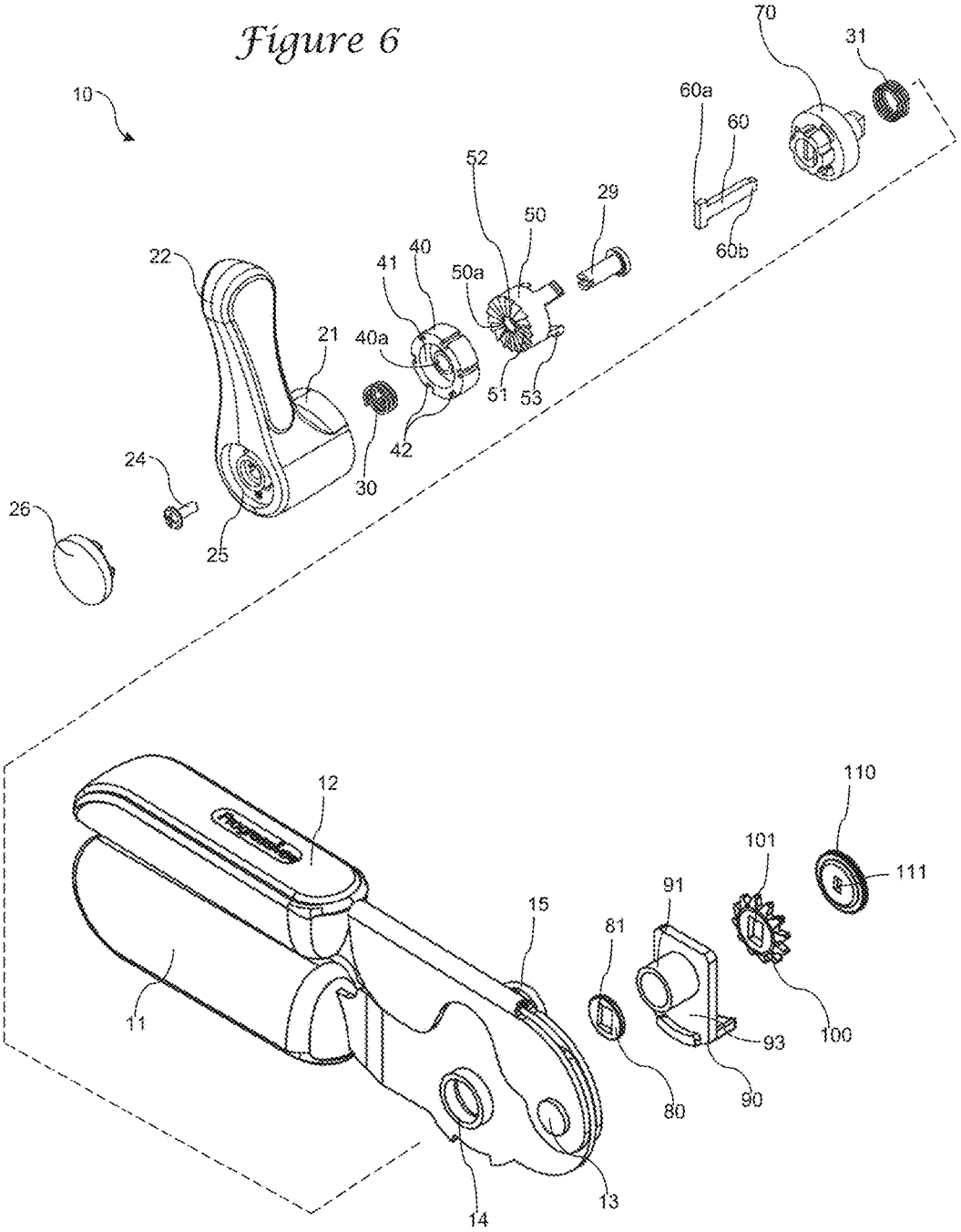
FIG. 6 is a top perspective exploded view of a preferred can opener.
Figure 7:
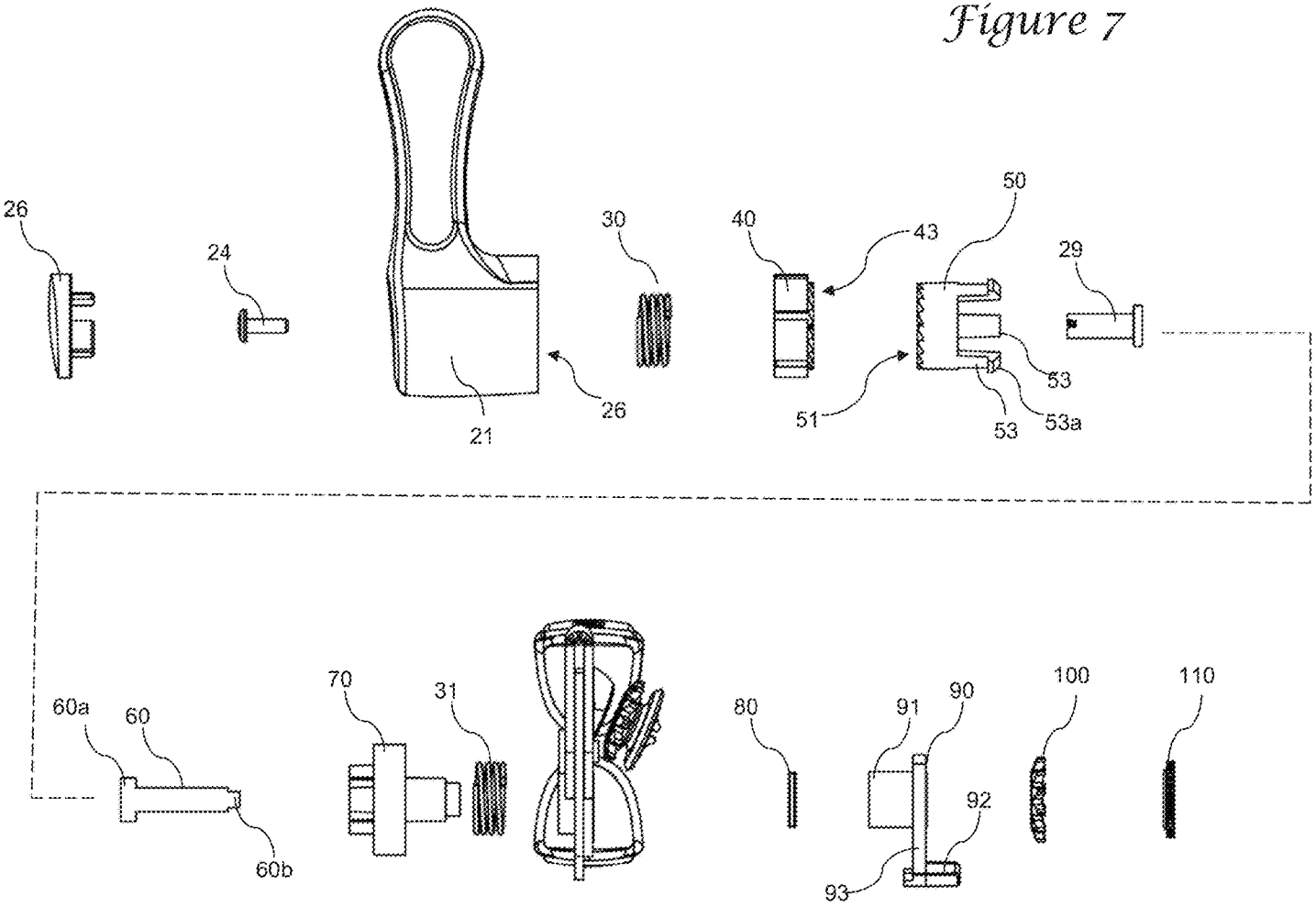
FIG. 7 is a left side plan exploded view of a preferred can opener.

As best seen with reference to the exploded views of FIGS. 6 and 7, in one example, the cavity 26 within the crank case 21 is shaped to receive a first gear 40. The interior sidewalls of the crank case 21 are preferably formed with features to prevent rotation of the first gear 40 with respect to the crank case. Thus, in the illustrated example, the crank case 21 includes a series of axial ribs 27 (see FIG. 8) extending axially along the interior sidewalls of the generally cylindrical shaped cavity and parallel with a central axis C-C extending through the center of the cavity 26. Accordingly, the ribs are parallel to a direction of pivoting movement of the crank when the crank is pivoting to drive the traction wheel 110.

The first gear 40 includes a series of mating slots, e.g. 42, configured to receive the axial ribs 27 formed within the crank case 21, so that the ribs 27 prevent rotational movement of the first gear 40 within the cavity 26 of the crank. As illustrated, the crank housing is formed with a generally cylindrical interior shape, and the first gear 40 includes a mating cylindrical exterior sidewall in order to fit within the crank case. The slot and rib arrangement allows the first gear 40 to slide in an axial direction into and out of the cavity 26, but not to rotate within the cavity.

In an alternate version of the invention, the slot and rib configuration of the crank case cavity 26 and the first gear are reversed, with slots formed in the crank case and ribs positioned on the first gear. Accordingly, in general the crank case 21 and first gear 40 include mating surfaces to define an axial path of travel of the first gear 40 with respect to the crank case 27, while restricting the first gear 40 against rotational movement within the crank case 21.

A first end of the first gear 40 includes a recessed area 41 having a cylindrical shape for receiving a first spring 30, which is preferably a coil spring. The first spring 30 is trapped in a space between an end wall within the crank case (that is, the interior wall opposite the open rim of the cavity) and the recessed area 41 of the first gear. Accordingly, the first spring 30 provides an outward axial force against the first gear 40, pushing it in a direction axially outward from the crank case housing and cavity 26. The first gear 40 includes a series of inclined teeth 43 formed on an opposing second end of the first gear, axially opposite the recessed area 41 positioned on the first end of the first gear 40. Preferably, the inclined teeth are formed in a circular arrangement about the second end of the first gear 40.

A second gear 50 is formed with a cylindrical exterior body and a first end with a series of inclined teeth 51. The inclined teeth 51 of the second gear 50 are configured and oriented such that they slide over the inclined teeth 43 formed on the first gear when the first gear 40 is rotated in one direction, but the teeth engage one another when the first gear 40 is rotated in an opposite rotational direction.

The second gear 50 is formed with an outer cylindrical shape having a diameter that is smaller than an interior diameter between the surfaces of opposing axial ribs 27 of the cavity 26, so that the second gear 50 can be received within the cavity 26 in the housing for rotational movement of the second gear 50 within the housing, without being restricted by the axial ribs 27 as is the case with the first gear 40. Thus, the first gear 40 rotates with the crank; the second gear 50 rotates together with the first gear 40 and the crank case 21 in a first direction of rotation (preferably, clockwise) but the second gear 50 does not rotate with the first gear 40 in an opposite direction of rotation of the crank (preferably, counterclockwise).

Figure 9:
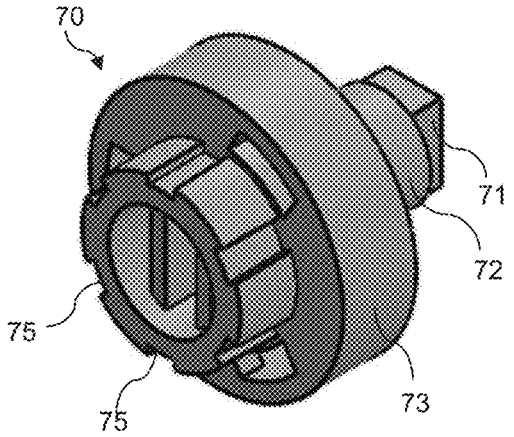
FIG. 9 is a perspective view of a housing cap for a preferred can opener.
Figure 10:
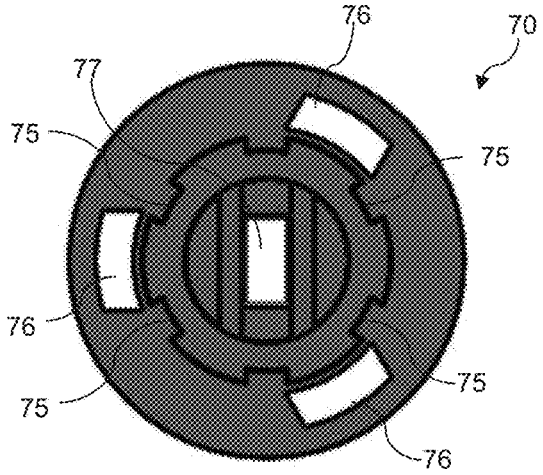
FIG. 10 is a front plan view of the housing cap of FIG. 9.
Figure 11:
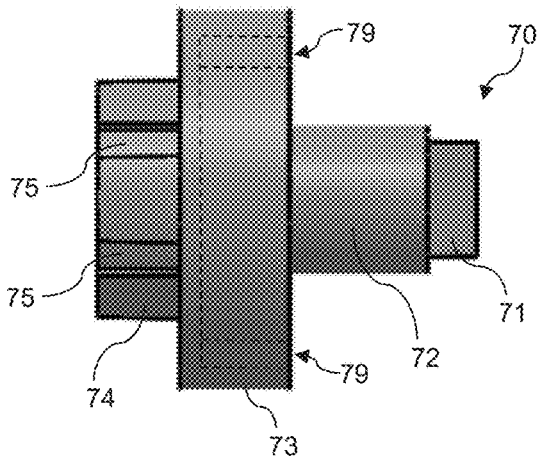
FIG. 11 is a right side plan view of the housing cap of FIG. 9.

The second end of the second gear 50, opposite the first end having the inclined teeth 51, terminates with a plurality of legs 53 having radially outward extending feet 53*a*. In the illustrated example, three such legs 53 are shown. The legs and feet are received within corresponding slots 76 formed in a housing cap 70 (best seen in FIGS. 9-11), in order to join the second gear 50 and the end cap 70 together for common rotational movement. The housing cap 70 further includes a series of axial grooves 75 formed on a first cylindrical end 74. The axial grooves 75 receive a complementary series of ribs formed within a cavity within the second end of the second gear 50, to further ensure common rotational movement of the end cap 70 and the second gear 50.

A screw 24 extends axially through the crank case 21 and is received within an internally threaded axle 29. The axle 29 extends through central bores 40*a*, 50*a* formed in the second gear 50 and the first gear 40. The axle also carries the first spring 30, thereby joining the first and second gears 40, 50 together. A sealing cap 26 covers the screw 24 and is received within a shallow well 25 formed in the crank opposite the open end of the cavity 26. The axle 29 is formed with a length to allow for a small amount of axial travel of the second gear 50 with respect to the first gear 40, thereby allowing the second gear to move axially outward from the first gear when the crank is rotated in a direction that causes the inclined teeth of the gears to slide over one another. The first spring 30 pushes the gears lightly toward one another to ensure that the gear teeth 51, 43 mesh in the first direction but slip over one another in the opposite direction.

The axial ribs 27 formed within the crank case are configured with a length that stops short of the rim 28 of the cavity 26 of the crank case, forming an outermost portion of the crank housing cavity having a cylindrical interior shape and without ribbing. A central portion 73 of the end cap 70 is formed with a cylindrical shape that fits snugly within this outer end of the crank case 21 in order to seal the crank case within the end cap.

The end cap 70 further includes a central channel 77, formed with a rectangular cross section for receiving a center pin 60, which is also formed with a rectangular cross section in order to drive the center pin 60 rotationally together with the end cap 70. Most preferably, as in the illustrated version, the rectangular shape has a height that is much greater than the width.

A spacer 90 is configured with a cylindrical sleeve 91 attached to a first side of a plate 93, with a lower curved flange 92 positioned on an opposite side of the sleeve 91. The sleeve is seated within a collar 14 formed in the first handle 11.

The end cap 70 includes a narrow cylindrical stem 72 on a side of the central portion of the end cap 70 opposite the first cylindrical end, and terminates with a keyed terminal end 71 which, in the illustrated example, has a rectangular cross section. The cylindrical stem 72 of the end cap 70 extends through the sleeve 91 and collar 14 formed at the proximal end 11*a* of the first handle 11. Most preferably, the collar is positioned adjacent the pivot location 13 but between the pivot location and the distal end 11*b* of the first handle 11.

A second spring 31 is preferably formed as a coil spring and is carried on the sleeve 91. The second spring 31 is sized such that it is trapped between an upper rim formed by the collar 14 at one end, and is received within an annular interior cavity 79 formed within the central portion 73 of the end cap 70 at the other end. Accordingly, the second spring 31 provides an axially outward force on the end cap 70, and therefore on the crank and crank handle, to urge them away from the handle.

The crank case 21, with its ratchet assembly as described above, is positioned on a first side of the first handle 11, with the center pin 60 and cylindrical stem of the end cap 70 extending through the first handle to the second side of the first handle. In the illustrated example, the center pin 60 is formed with a head end 60*a* having opposing flanges, and a tail end 60*b* which is narrower than the main body of the center pin 60. The head end 60*a* is trapped against corresponding shoulders of the end cap 70 while the body of the center pin 60 extends through the slot 77 in the end cap. The narrowed tail end 60*b* is eventually flattened to form a flared terminal end 61, trapping the traction wheel 110 as described further below.

On the second side of the first handle 11, the cylindrical stem 72 extends into the sleeve 91 and engages a washer 80 having a rectangular central hole 81 sized to receive the terminal end 71 of the end cap, which is formed with a mating rectangular cross section. The washer 80 is formed with an outer diameter larger than the inner diameter of the sleeve 91, so that the washer 80 cannot pass through the sleeve 91.

The terminal end 71 of the end cap 70 extends beyond the sleeve 91, the outer plate 93 of the spacer 90, and the washer 80, where it receives a drive gear 100 having a rectangular central opening 101 to receive the mating terminal end 71 of the end cap 70. The terminal end of the end cap therefore drives the washer and drive gear for common rotation.

A traction wheel 110 is positioned axially beyond the drive gear. The traction wheel includes a central opening 111 sized to receive the head end 60*a*, formed as a small rectangular tip, of the center pin 60, which is then flattened to form a flange 61 after passing through the traction wheel 110 to trap the traction wheel (and the other parts described above) between the two ends of the center pin 60.

As best seen in FIG. 1, the second handle 12 includes a cutting assembly which interacts with the traction wheel 110 to engage a can to be opened. A blade mount 17 extends outwardly from the second handle 12 at an inclined angle, providing a support for an axle which carries the blade 15. A driven gear 16 is carried on the axle on the second handle 12 and is positioned to mesh with the drive gear 100 of the first handle 11 when the first and second handles 11, 12 are pivoted to a closed position. The cutting blade 15 is also carried on the axle, preferably spaced apart axially outward from the driven gear 16. The cutting blade 15 is also positioned so that it is spaced outward from the traction wheel 110, and at an angle with respect to the traction wheel 110 that is non-parallel.

In use, with the distal ends 12*c*, 11*b* of the handles 11, 12 pivoted to a slightly open position, a rim of a can is inserted into the space between the traction wheel 110 and the blade 15, in which the blade 15 is positioned on an interior edge of the rim and the traction wheel 110 is positioned on an exterior edge of the can. The first and second handles 11, 12 are pivoted to the closed position, trapping the rim of a can between the traction wheel 110 and the blade 15. The crank handle 22 is reciprocated back and forth, moving the crank back and forth along a pivotal path, clockwise and counterclockwise as indicated by arrow B in FIG. 1. In the first direction, the teeth of the first gear 40 and the second gear 50 engage one another, causing rotation of the second gear 50, end cap 70, drive gear 100, and traction wheel 110 together. The drive gear 100 further causes rotation of the driven gear 16 and the blade 15, piercing the lid of the can as the blade 15 travels around the upper rim. When the crank handle 22 is moved in the second direction, opposite the first rotational direction, the inclined teeth 43, 51 of the first and second gears 40, 50 slip over one another, with the compression of the first spring 30 and/or the second spring 31 to allow the gears to move apart from one another. This reciprocating motion of the crank handle 22 is repeated as the blade travels around the rim of the can until it is entirely cut.

In a preferred version of the invention, each of the first and second handles 11, 12 are made from steel, with plastic outer handle plugs and an outer handle grip formed from a thermoplastic elastomer. The gears 40, 50 and endcap 70 may be formed from plastic materials, with the center pin 60, washers 80, drive and driven gears 100, 15, and traction wheel 110 being formed from steel or other suitable metals.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A can opener, comprising:

a first handle having a distal end and a proximal end;

a second handle having a distal end and a proximal end, the proximal ends of the first handle and the second handle being pivotally attached to one another at a pivot location for rotational movement of the first handle with respect to the second handle about the pivot location;

a crank handle attached to a crank case, the crank case being attached to the first handle and having interior sidewalls forming cylindrical interior cavity and terminating in a rim, the sidewalls having at least one rib positioned on the sidewalls and extending axially along the sidewall;

a ratchet assembly received within the crank case cavity, the ratchet assembly comprising:

a first gear having at least one slot configured to receive the at least one rib wherein the first gear is axially movable within the crank case cavity along the rib, the first gear having a first set of ratchet teeth;

a second gear having a second set of ratchet teeth configured to engage the first set of ratchet teeth when the first gear is rotated in a first direction and to slide over the first set of ratchet teeth when the first gear is rotated in a second direction;

a drive gear coupled to the second gear for rotation together with rotation of the second gear;

a traction wheel coupled to the second gear for rotation together with rotation of the second gear;

a driven gear attached to the second handle and positioned to be driven by the drive gear when the first handle and the second handle are pivoted toward one another in a closed position; and a blade attached to the second handled adjacent the driven gear.

2. The can opener of claim 1, wherein the crank case cavity further comprises an interior end wall, and the ratchet assembly further comprises a first spring trapped between the interior end wall and the first gear, whereby the first spring urges the first set of ratchet teeth lightly into engagement with the second set of ratchet teeth.

3. The can opener of claim 2, further comprising an axle extending axially through the first gear, the second gear, and the first spring, and a screw securing the axle to the crank case.

4. The can opener of claim 2, further comprising an end cap attached to the second gear for rotational movement together with the second gear, the end cap having a circular central portion sized to be received within and enclose the rim of the crank case cavity.

5. The can opener of claim 4, further comprising a center pin having a first end carried on the end cap and a second end attached to the drive gear and the traction wheel, the second end of the center pin being configured to retain the drive gear and the traction wheel on the first handle.

6. The can opener of claim 5, wherein the drive gear and traction wheel are mounted to the center pin for rotational movement together with the center pin.

7. The can opener of claim 5, further comprising a second spring trapped between the end cap and the first handle.

8. The can opener of claim 7, wherein the proximal end of the first handle further comprises a collar defining an opening for receiving a portion of the end cap and the center pin.

9. The can opener of claim 7, further comprising a sleeve integrally formed with a plate, the sleeve being received within the collar formed on a first side of the first handle and the mounting plate being positioned on an opposing second side of the first handle.

10. The can opener of claim 9, wherein the second gear further comprises a plurality of legs terminating in radially extending feet and the end cap further comprises a plurality of peripheral slots, a separate one of the legs being received within and retained by a separate one of the plurality of peripheral slots.

11. The can opener of claim 2, wherein the at least one rib comprises a plurality of ribs distributed about the sidewalls and the at least one slot comprises a plurality of slots, each of the plurality of slots being positioned to receive a corresponding one of the plurality of ribs.

12. The can opener of claim 11, wherein the crank handle is integrally formed with the crank case.

13. A can opener, comprising:

a first handle;

a second handle pivotally attached to the first handle;

a crank handle carried on a crank case and configured to drive a ratchet assembly, the crank case being positioned on a first side of the first handle;

the crank case having an interior crank case cavity and terminating in a rim;

the ratchet assembly being housed within the crank case cavity, the ratchet assembly comprising:

a first gear having a first set of ratchet teeth, the first gear and the crank case cavity further having complementary mating surfaces wherein the first gear is seated for axial moment in a direction into and out of the crank case cavity while constrained against rotational movement within the crank case cavity;

a second gear having a second set of ratchet teeth configured to engage the first set of ratchet teeth when the first gear is rotated together with the crank case in a first direction and to slide over the first set of ratchet teeth when the first gear is rotated in a second direction;

a drive gear positioned on a second side of the first handle and coupled to the second gear for rotation together with rotation of the second gear;

a traction wheel positioned on the second side of the first handle and coupled to the second gear for rotation together with rotation of the second gear;

a driven gear attached to the second handle and positioned to be driven by the drive gear when the first handle and the second handle are pivoted toward one another in a closed position; and a blade attached to the second handled adjacent the driven gear.

14. The can opener of claim 13, wherein the complementary mating surfaces comprise a plurality of ribs formed on the interior crank case cavity and a plurality of slots formed on a perimeter of the first gear, each of the plurality of slots being positioned to receive a corresponding one of the plurality of ribs.

15. The can opener of claim 14, wherein the crank handle is integrally formed with the crank case.

16. The can opener of claim 15, wherein the rim of the crank case abuts the first handle.

17. The can opener of claim 15, wherein the crank case cavity further comprises an interior end wall, and the ratchet assembly further comprises a first spring trapped between the interior end wall and the first gear, whereby the first spring urges the first set of ratchet teeth lightly into engagement with the second set of ratchet teeth.

18. The can opener of claim 17, further comprising an axle attached to the interior end wall, the axle extending axially through the first gear, the second gear, and the first spring.

19. The can opener of claim 18, further comprising an end cap attached to the second gear for rotational movement together with the second gear, the end cap having a circular central portion sized to be received within and enclose the rim of the crank case cavity.

20. The can opener of claim 19, further comprising a second spring trapped between the end cap and the first handle.

* * * * *